US007204015B2

(12) United States Patent
Kleshchik

(10) Patent No.: US 7,204,015 B2
(45) Date of Patent: Apr. 17, 2007

(54) ELECTRIC HEATING CLOTH METHOD

(76) Inventor: David Kleshchik, 6542 Hilltop Dr., Troy, MI (US) 48098

( * ) Notice: Subject to any disclaimer, the term of this patent is extended or adjusted under 35 U.S.C. 154(b) by 472 days.

(21) Appl. No.: 10/713,120

(22) Filed: Nov. 14, 2003

(65) Prior Publication Data

US 2004/0144771 A1 Jul. 29, 2004

Related U.S. Application Data

(62) Division of application No. 10/163,270, filed on May 11, 2002, now Pat. No. 6,649,886.

(51) Int. Cl.
*H05B 3/20* (2006.01)
*H05B 3/34* (2006.01)
*H05B 3/54* (2006.01)

(52) U.S. Cl. ..... 29/611; 29/620; 29/885; 219/529; 219/543; 219/545; 338/211; 338/214; 338/308

(58) Field of Classification Search ..... 29/611, 29/612, 613, 620, 91.1, 592.1, 610.1, 874, 29/876, 884, 885; 219/528, 529, 543, 545, 219/547, 549; 264/103, 105, 140, 172.15, 264/211.17; 338/211, 214, 308, 317; 427/117, 427/384

See application file for complete search history.

(56) References Cited

U.S. PATENT DOCUMENTS 1,736,745 A * 11/1929 Lohmann ..... 338/230
1,963,554 A * 6/1934 McDill ..... 338/208
2,065,760 A * 12/1936 Smith ..... 392/370
2,683,669 A * 7/1954 Coler ..... 252/511
2,703,356 A * 3/1955 Buchanan et al. ..... 338/211
3,114,825 A * 12/1963 Kilburn et al. ..... 219/540
3,311,862 A * 3/1967 Rees ..... 338/211
4,429,216 A * 1/1984 Brigham ..... 219/528
4,600,602 A * 7/1986 Martin et al. ..... 427/98.4
4,608,244 A * 8/1986 Sugihara et al. ..... 423/449.1
4,983,814 A * 1/1991 Ohgushi et al. ..... 219/545

OTHER PUBLICATIONS

Polyurethane, Random House Unabridged Dictionary.□□© 1997 by Random House, Inc., on Infoplease.□□© 2000-2006 Pearson Education, publishing as Infoplease.□□May 25, 2006 <http://www.infoplease.com/ipd/A0595193.html>.*

* cited by examiner

*Primary Examiner*—A. Dexter Tugbang
*Assistant Examiner*—Livius R Cazan
(74) *Attorney, Agent, or Firm*—Alex Rhodes

(57) ABSTRACT

A method for producing a uniformly heated electric heating cloth comprising the steps of forming heating threads by dissolving a thermoplastic polymer in an organic solvent, adding an industrial carbon which is produced from acetylene to form a first mixture, grinding the mixture of industrial carbon and thermoplastic polymer, adding a colloidal graphite to form a second mixture, grinding the second mixture, coating threads with the second mixture in a spinneret, heating the coated threads to remove the organic solvent; and interweaving the coated heating threads with non-conducting threads in a perpendicular direction.

19 Claims, 5 Drawing Sheets

ELECTRIC HEATING CLOTH METHOD

CROSS-REFERENCE TO RELATED APPLICATIONS

This application is a division of application Ser. No. 10/163,270, filed on May 11, 2002, now U.S. Pat. No. 6,649,886.

FIELD OF THE INVENTION

This invention relates to a method for manufacturing an electric heating cloth and more particularly to a method for manufacturing a highly reliable, highly flexible electric heating cloth for maintaining a uniform temperature in a heating zone.

BACKGROUND OF THE INVENTION

Present-day demands to control temperatures generate a high interest in flexible electric heating devices for ensuring a temperature parameter. Cloth heaters are a type of flexible electric heating means for heating various surfaces and media that is easily adaptable to an application site. Among the devices that require electric heating cloths are automotive heated seats, heated steering wheels, automotive engine oil crankcases, cement hardening heaters, clothes with heating elements, thermal blankets, etc.

Simple flexible electric heaters are usually comprised of thin metallic electric heating wires connected to a flexible surface in a serpentine shape. The electric energy supplied to the heating wires is dissipated, thus dissipating the heat from the wire into the environment. The insulating material that covers the heating wires from both sides ensures electric insulation and heat propagation. However, heat generation with heating wires has so far resulted in non-uniform heating, which is especially noticeable in devices in which the heater is installed in close proximity to a person. Besides, metallic heating elements are susceptible to bending and twisting and have a tendency to break. Also, the maximum heating temperature range is limited by the heating wire gauge. Application of simple cloth electric heaters is an attempt to alleviate the problems of flexible electric heaters by using multiple conducting threads interweaved in the cloth, as heating elements. The cloth is a combination of heating conducting threads of a "shell-nucleus" type that run in one direction, and primary threads that run in another direction. The electric energy is supplied to the heating threads with the help of low-resistance conducting threads along the cloth edges that are arranged perpendicular to the heating threads in the cloth.

Cloth heaters alleviate the problem of non-uniform heating by use of multiple parallel heating threads connected with each other by conducting bus bars.

In some applications, such as automotive seat heaters, it is desirable that a constant operating heating temperature of approximately 37° C. be maintained, with provisions to raise it to about 150° C. within a short period of time during fabrication of seats in order to ensure melting of the adhesive material that bonds of the car seat material to the foam.

Introduction of modern composite materials that can withstand reasonably high temperatures made it possible to produce devices that are not susceptible to limitations on the maximum heating temperature within a permissible range. Use, in the cloth, of "shell-nucleus" type heating resistive threads produced with the help of known processes does not make it possible to expand the temperature range as required, due to reasons that will be described below.

For example, from WO, 95/17800, HO5B 3/36, publ. Jun. 29, 1995, an electric heating woven thread cloth is known that has 0.3–3.5 kOhm/m linear electric resistive heating threads both in the weft and the warp. The heating resistive thread used in the known cloth has a "shell-nucleus" structure, in which the "nucleus" consists of polycaproamide fiber, and the "shell" that serves as the resistive material is a composite that includes a tetrafluoroethylene co-polymer with vinylidene fluoride and industrial carbon. The heating resistive thread is produced by applying a coat of resistive material on polycaproamide fiber.

The disadvantages of this heating resistive thread are: low linear electric resistance, which limits its use to fabrication of woven heating elements that are suitable for work at voltages not exceeding 36 V; use of polycaproamide fiber of a certain configuration, only, as a "shell" for its production; and higher resistive material consumption.

Besides, the heating temperature of the woven heating element, produced using this thread as a basis, cannot exceed the polycaproamide fiber melting point (100–110||C.), otherwise, the heating element will be ruined. Two conducting bus bars arranged in the same direction as non-conducting threads are located in the cloth at a considerable distance from one another, thus making wire connection inconvenient.

U.S. Pat. No. 4,983,814, issued on Jan. 8, 1991 contains a description of an electric heating cloth with 1–100 kOhm/m linear electric resistance heating threads in the weft.

The heating resistive thread for this fiber also has a "shell-nucleus" structure, in which the "nucleus" consists of a nylon-, polyester- or polyolefin type (all having low melting points within 100–120° C. temperature range) synthetic fiber or high-melting polyfluoroethylene and polyamide type, and the "shell" that serves as the resistive material, is a composite that contains a polyester type polyurethane resin and a carbon filler at a mass ratio of 1:0.3 and 1:1, respectively.

The carbon filler used is industrial carbon (produced from oven or channel acetylene, and their mixtures) or graphite (natural, with a dense crystalline, flaky or amorphous structure, and artificial) at a mass ratio of 1:1.67 and 1:4 (column 8, paragraph 2 in the description) or 1:0.5 and 1:0.6 (in examples 1 and 2), respectively.

The heating resistive thread is produced by applying from one to three coats of the resistive material to the synthetic thread described above at a mass ratio of 1.7:1 and 2.8:1, respectively.

The disadvantages of this conductive thread are: requirements to apply two or three coats of the resistive material on the resistive thread "nucleus" and a heavy consumption of the resistive material even with single-coat "shell", which increases the thread production cost. Besides, this conductive thread has two conductive bus bars that are arranged in the same direction as non-conducting threads and located in the cloth at a considerable distance from one another, thus making a wire connection inconvenient.

In view of the above, some requirements may be set forth that the conducting heating thread should meet, namely: improvement in heating properties of flexible heaters; uniform heating of the cloth surface for higher user comfort; greater operating temperature range; conveniences during the installation of the heating element and lower production cost. The market needs a better heating material that may be used in various applications and be reliable and efficient.

SUMMARY OF THE INVENTION

The invention is based on the tasks of developing an electric heating cloth that is heated uniformly over the entire surface of the cloth; developing an electric heating cloth which has a wide operating temperature range; and developing an electric heating cloth which has multiple heating sections over the entire surface of the cloth which minimizes the necessity of having multiple electric outlets, making connections to a power source more convenient and reducing the cost of fabricating electric heaters.

The technical result achieved therein lies in enhancement of service properties of the electric heating cloth, its reliability and efficiency due to uniform heating of the cloth surface area; opportunities to heat different fiber sections to different temperatures; convenience during fabrication of flexible electric heaters.

According to this invention, the electric heating cloth consists of a set of primary non-conducting threads and at least two conducting bus bars arranged along the warp. Between the pair of conducting bus bars there is a second set of primary non-conducting threads and heating resistive threads. At least two distributing bus bars are connected to the conducting bus bars in order to supply electric power. Each conducting bus bar and each distributing bus bar contains at least one low-resistance thread that serves as an electric conductor. Primary, heating and low-resistance threads make up the main set of elements required to form electric heating cloth that has suitable structure and suitable temperature range characteristics.

This technical result is achieved because the electric heating cloth per fabrication alternative 1, which is a cloth produced by interweaving the threads and consisting of cotton or synthetic primary non-conducting threads arranged in the first direction, and 2.7–1800 Ohm/cm linear electric heating resistive threads arranged in the second direction, perpendicular to the first one, each of them consisting of synthetic or glass fiber with a shell from polymer resistive material that contains a carbon filler consisting of industrial carbon and graphite, has at least three conducting bus bars arranged in the first direction which coincides with the direction of the primary non-conducting threads for distribution of electric energy between heating resistive threads, and at least two distributing bus bars arranged in the second direction which coincides with the direction of heating resistive threads and separated from the latter by non-conducting cotton or synthetic fiber threads that are arranged in the second direction as well and create a dielectric barrier between the distributing bus bars and heating resistive threads, in which there are circuit breakers for distribution of the electric energy between the conducting bus bars, the said conducting bus bars are located in the cloth at equal distances between each other, heating resistive threads are located between the said bus bars in order to transfer the electric energy from one bus bar to the other, and each conducting bus bar and each distributing bus bar contains at least one low electric resistance, copper-plated thread.

Cotton, KEVLAR®, NOMEX® or caprone threads may be used as the non-conducting material. The same materials, except cotton, and glass fiber may be used as the "nucleus" of the heating resistive threads.

Heating resistive threads may have high or low linear electric resistance ranging from 2.7 to 1800 Ohm/cm.

Low linear electric heating resistive threads form conducting and distributing bus bars made from synthetic fiber coated with low electric resistance material, e.g. copper or tin, or lead or aluminum.

The density of the primary and/or heating resistive threads in the cloth ranges from 8 to 18 filaments per cm.

It is expedient that the conducting bus bars should be 1–20 mm wide and consist of 4–80 separate, low electric resistance threads, and the distributing bus bars should be 10–50 mm wide and contain 8–90 separate, low electric resistance threads.

This technical result is achieved because the electric heating cloth per fabrication alternative 2, which is a cloth produced by interweaving the threads and consisting of at least two electric heating sections, each intended for uniform heating of certain sections to various temperatures, the cloth consisting of cotton or synthetic fiber primary non-conducting threads arranged in the first direction, and 2.7–1800 Ohm/cm linear electric heating resistive threads arranged in the second direction, perpendicular to the first one, each of them consisting of synthetic or glass fiber with a shell from polymer resistive material that contains a carbon filler consisting of industrial carbon and graphite, has at least three conducting bus bars arranged in the first direction which coincides with the direction of the non-conducting threads for distribution of electric energy between heating resistive threads, and at least two distributing bus bars arranged in the second direction which coincides with the direction of heating resistive threads and separated from the latter by non-conducting cotton or synthetic threads that are arranged in the second direction as well and create a dielectric barrier between the distributing bus bars and heating resistive threads, in which there are circuit breakers for distribution of the electric energy between the conducting bus bars, the said conducting bus bars are located in the cloth at different, specified distances between each other in order to create heating sections that vary in resistance and capacity, heating resistive threads are located between the said bus bars in order to transfer the electric energy from one bus bar to the other, and each said conducting bus bar and each said distributing bus bar contains at least one low electric resistance, copper-plated thread. The electric resistance of each section is determined by the distance between the conducting bus bars.

This technical result is achieved because the electric heating cloth per fabrication alternative 3, which is a cloth produced by interweaving the threads that has one electric heating section consisting of cotton or synthetic fiber primary non-conducting threads arranged in the first direction, and 2.7–1800 Ohm/cm linear electric heating resistive threads arranged in the second direction, perpendicular to the first one, each of them consisting of synthetic or glass fiber with a shell from polymer resistive material that contains a carbon filler consisting of industrial carbon and graphite, has two conducting bus bars arranged in the first direction which coincides with the direction of the primary non-conducting threads for distribution of electric energy between heating resistive threads, and one distributing bus bar arranged in the second direction which coincides with the direction of heating resistive threads and separated from the latter by non-conducting cotton or synthetic threads that are arranged in the second direction as well and create a dielectric barrier between the heat conducting resistive threads and the distributing bus bar, in which there is a circuit breaker for distribution of the electric energy between the conducting bus bars, the said conducting bus bars are located in the cloth at specified distances between each other, conducting resistive threads are located between the said bus bars in order to transfer the electric energy from one bus bar to the other, and each said conducting bus bar and each said distributing bus bar contains at least one low electric resistance thread.

The invention is also based on the task to reduce the consumption of the polymer resistive material and, at the same time, expand the linear electric resistance range of the heat conducting resistive thread used to fabricate woven heating elements operating within the 6–380 V range. The technical result achieved therein lies in enhancement of the thread service properties and efficiency due to lower consumption of the polymer resistive material that is applied to the primary thread and in the expansion of the linear electric resistance range.

With respect to the thread, this technical result is achieved by the fact that the polymer carbon filler used to fabricate the heat conducting resistive thread consisting of a synthetic or glass fiber with a shell made from polymer resistive material that contains industrial carbon and graphite has been produced from polyvinylidene fluoride thermosoftening plastic and carbon filler at a mass ratio from 1:0.3 to 1:0.6, respectively; the carbon filler includes industrial carbon produced from acetylene and colloid graphite at a mass ratio from 1:0.1 to 1:1.4, respectively, and the mass ratio of the polymer resistive material and the source fiber is within the 0.2:1–0.65:1 range, respectively.

With respect to the thread fabrication method, this technical result is achieved by the fact that the heat conducting resistive thread fabrication method lies in preparation of a polymer resistive material, which contains carbon filler consisting of industrial carbon and graphite, and application of the same in the form of a shell on the synthetic or glass fiber; in order to prepare the said polymer resistive material a 12–15% solution of polyvinylidene fluoride in acetone is produced by mixing components in an air-tight mixer at room temperature until the thermosoftening plastic is completely dissolved. The industrial carbon is mixed with the polymer solution produced, the resulting suspension is made to circulate in a closed "mixer-grinder-mixer" loop to ensure dispersion of the industrial carbon particles and production of a homogeneous solution, which is then mixed with colloid graphite, and the entire mixture is ground and then applied in the form of a shell on the primary thread by passing it through the solution and a spinneret whose orifice diameter controls the amount of the resistive material to be applied on the thread. After that, the solvent is removed from the resistive shell by drying the thread in a hot air stream at 105–110° C.

The features of each cloth and thread production method indicated are essential and related to each other because they create a stable combination of essential features, which is sufficient to produce the technical result required.

BRIEF DESCRIPTION OF THE DRAWINGS

The examples shown in the drawings merely demonstrate the opportunities which are possible with the invention and are not intended to limit the scope of the invention.

DETAILED DESCRIPTION OF A PREFERRED EMBODIMENT

Figure 1:
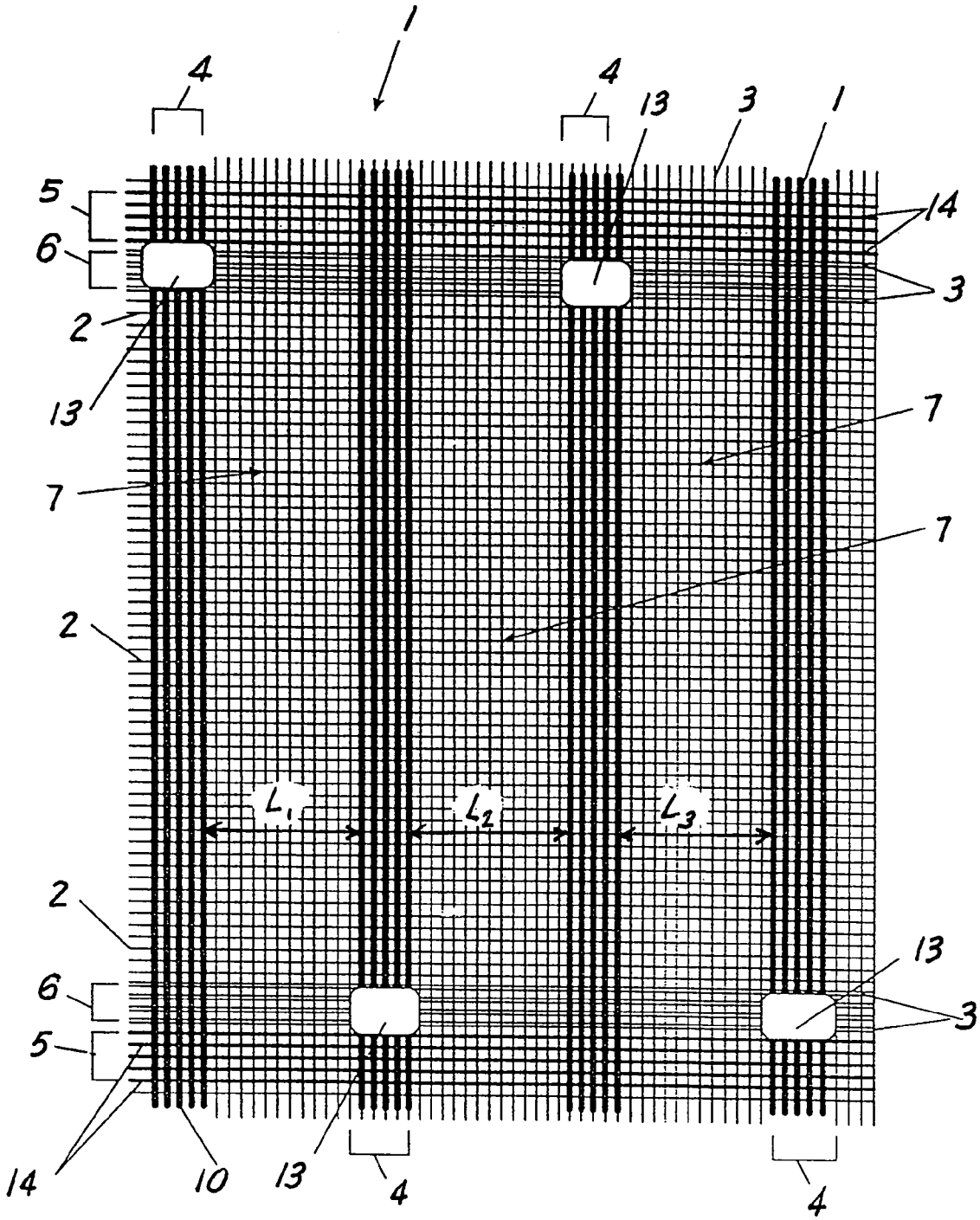
FIG. 1 shows an electric heating cloth according to the invention.

According to the invention, the electric heating cloth per fabrication alternative 1, is a cloth produced by interweaving the threads and comprises cotton or synthetic primary non-conducting threads arranged in a first direction, and 2.7–1800 Ohm/cm linear electric resistance conducting resistive threads arranged in a second direction, perpendicular to the first one. Each conductive resistive thread comprises a synthetic or glass fiber with a shell made from a polymer resistive material that contains a carbon filler consisting of industrial carbon and graphite. The cloth also has at least three conducting bus bars arranged in the first direction which coincides with the direction of the primary non-conducting threads for a distribution of electric energy between the conducting resistive threads, and at least two distributing bus bars arranged in the second direction which coincides with the direction of the conducting resistive threads and is separated from the latter by the non-conducting cotton or synthetic threads that are arranged in the second direction as well and creates a dielectric barrier between the distributing bus bars and the conducting resistive threads, in which there are circuit breakers for distribution of the electric energy between the conducting bus bars. The conducting bus bars are located in the cloth at equal distances between each other. The conducting resistive threads are located between the bus bars in order to transfer the electric energy from one conducting bus bar to another. Each conducting bus bar and each distributing bus bar contains at least one low electric resistance, copper-plated thread.

Also, according to the invention, the electric heating cloth which is a cloth produced by interweaving the threads has at least two electric heating sections, each intended for uniform heating of certain areas to various temperatures. The cloth consists of cotton or synthetic primary non-conducting threads arranged in the first direction, and 2.7–1800 Ohm/cm linear electric resistance conducting resistive threads arranged in the second direction, perpendicular to the first one, each of them consisting of synthetic or glass fiber with a shell from polymer resistive material that contains a carbon filler consisting of industrial carbon and graphite. The cloth also has at least three conducting bus bars arranged in the first direction which coincides with the direction of the non-conducting threads for distribution of electric energy between conducting resistive threads, and at least two distributing bus bars arranged in the second direction which coincides with the direction of conducting resistive threads and separated from the latter by non-conducting cotton or synthetic threads that are arranged in the second direction as well and create a dielectric barrier between the distributing bus bars and conducting resistive threads, in which there are circuit breakers for distribution of the electric energy between the conducting bus bars. The said conducting bus bars are located in the fabric at different distances between each other in order to create heating sections with various resistance and capacity, conducting resistive threads are located between the said bus bars in order to transfer the electric energy from one conducting bus bar to another, and each said conducting bus bar and each said distributing bus bar contains at least one low electric resistance, copper-plated thread.

Low linear electric resistance conducting resistive threads used in conducting and distributing bus bars consist of synthetic thread coated with low electric resistance material, such as copper, lead or aluminum.

The density of primary threads and/or conducting resistive threads in the fabric is 8–18 threads per centimeter.

Conducting bus bars are 1–2-0 mm wide and contain 4–80 separate low electric resistance threads, while distributing bus bars are 10–50 mm wide and contain 8–90 separate low electric resistance threads.

According to the invention, the electric heating cloth, which is a cloth produced by interweaving the threads, has one electric heating section that consists of cotton or synthetic primary non-conducting threads arranged in the first direction, and 2.7–1800 Ohm/cm linear electric resistance conducting resistive threads arranged in the second direction, perpendicular to the first one, each of them consisting of synthetic or glass fiber with a shell from polymer resistive material that contains a carbon filler consisting of industrial carbon and graphite. The cloth also has two conducting bus bars arranged in the first direction which coincides with the direction of the primary non-conducting threads for distribution of electric energy between conducting resistive threads, and one distributing bus bar arranged in the second direction which coincides with the direction of conducting resistive threads and separated from the latter by non-conducting cotton or synthetic threads that are arranged in the second direction as well and create a dielectric barrier between the conducting resistive threads and the distributing bus bar, in which there is a circuit breaker for distribution of the electric energy between the conducting bus bars. The said conducting bus bars are located in the fabric at certain specified distances between each other. Conducting resistive threads are located between the said bus bars in order to transfer the electric energy from one conducting bus bar to the other, and each said conducting bus bar and the distributing bus bar contains at least one low electric resistance, copper-plated thread.

Specific examples of the cloth fabricated according to this invention are shown below:

FIG. 1 shows electric heating cloth 1 according to this invention. Electric heating cloth 1 consists of flexible cloth that ensures heat distribution in two operational modes at the same time: high heating mode and normal heating mode.

Electric heating cloth 1 contains heat conducting resistive threads 2 that run horizontally and are interweaved with primary non-conducting threads 3 that run vertically in the warp in order to form the woven cloth that has conducting bus bars 4 in the warp. Distributing bus bars 5 serve to distribute the energy between conducting bus bars 4 and are arranged along the cloth weft outside the heating sections of the cloth. Dielectric zone 6 made from non-conducting threads separates bus bars 5 from heating field 7. The electric current from the power source is distributed between conducting bus bars 4 with the help of distributing bus bars 5. Part of the energy flowing through conducting bus bars 4 is dissipated due to resistance of bus bars 4, and the rest of the energy is dissipated during flowing through conducting resistive threads 2 that are connected in parallel between the pairs of conducting bus bars 4.

Figure 6:
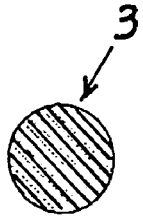
FIG. 6 is a cross-sectional view of a non-conducting thread.

Primary non-conducting threads 3 provide the cloth structure for conducting resistive threads 2. FIG. 6 shows primary non-conducting thread 3 used in this fabrication alternative. Although cotton and caprone are used herein as the material for the primary threads, the invention provides for use of other suitable non-conducting materials, such as nylon or nomex, or combinations thereof. Non-conducting threads 3 are located in the cloth warp and have a density of 8–18 threads per centimeter. Non-conducting threads 3 are also located along the weft in the dielectric zone 6 and have a density of 8–18 threads per centimeter.

Figure 5:
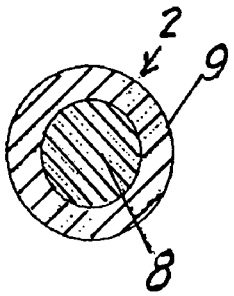
FIG. 5 is a cross-sectional view of a high resistance conducting resistive thread.

Conducting resistive threads 2 shown in FIG. 1 are connected in parallel between the pairs of conducting bus bars 4 that are located in the cloth warp. Primary non-conducting threads 3 are interweaved with conducting resistive threads 2 in order to ensure structural strength. The density of conducting resistive threads 2 should vary from 8 to 18 threads per centimeter. FIG. 5 shows conducting resistive thread 2 used in this alternative. Conducting resistive thread that has a "shell-nucleus" structure consists of a core or central thread 8 made from glass or synthetic fiber and a carbon-filled polymer coating or shell 9, thus creating a path for the conduction of electric energy. Generally, the polymer shell contains a filler consisting of industrial carbon and graphite.

Although glass fiber and caprone are used as the central thread materials in this alternative, the principles of the invention provide for use of other materials that have a broad operating temperature range and endure adequate structural strength, such as nylon and nomex. The resistance of each conducting resistive thread ranges from 2.7 to 1800 Ohm/cm. The electric energy flowing through threads 2 is dissipated due to resistance of these threads 2, thus causing the heat to propagate in heating field 7.

Figure 2:
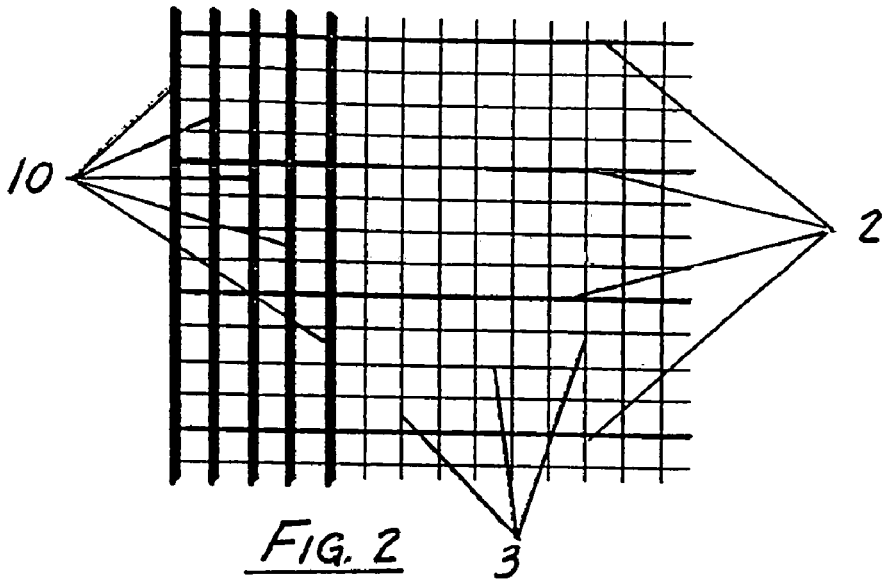
FIG. 2 is an enlarged view of a heat conducting resistive filament connection with a conducting bus bar.
Figure 4:
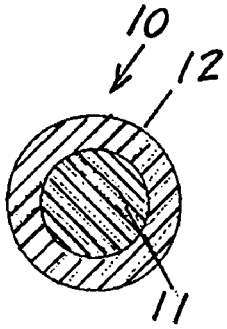
FIG. 4 is a cross-sectional view of a conductive resistive thread.

Conducting bus bars 4 shown in FIG. 1 are arranged along the cloth warp for distribution of energy between conducting resistive threads 2 at equal distances L from each other ($L_1=L_2=L_3$), which is why resistance R is the same in each section. Each conducting bus bar 4 is connected to conducting resistive threads 2 throughout its length and to distributing bus bar 5 at the end. Conducting bus bars 4 are connected to each other in parallel. Electric energy from the power source flows along distributing bus bar 5 to conducting bus bar 4 and through conducting resistive threads 2. All this partially resembles an electric circuit. Conducting bus bars 4 shown in FIG. 2 contain at least one low resistance thread 10. Conducting resistive threads 2 are interweaved with conducting bus bars 4 and provide electric contact due to pressure created by interweaving. FIG. 4 shows low resistance "shell-nucleus" type thread 10 that has a core or central thread 11 made from caprone or Kevlar and covered with copper, which, in its turn, is coated with tin. Although caprone or Kevlar are used as the core material in this alternative, the invention provides for use of other materials that have adequate strength, flexibility and operating temperature range, such as nylon, nomex, etc. Other materials and combinations thereof may also be used, depending on the engineering design.

Figure 3:
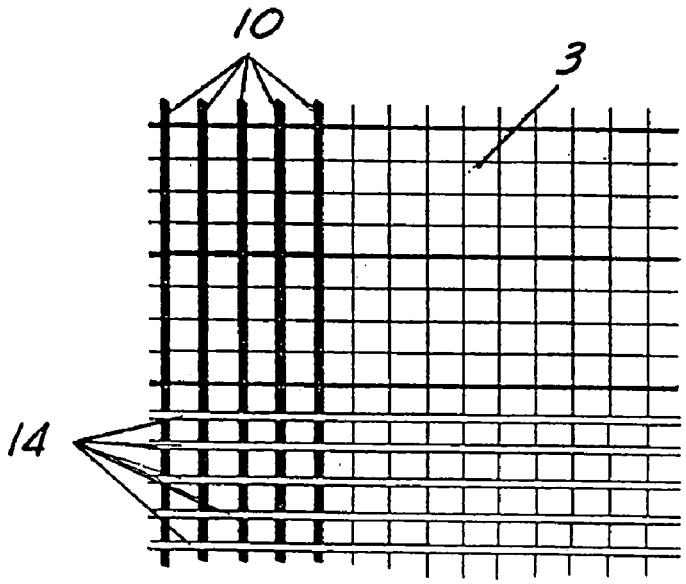
FIG. 3 is an enlarged view of a conducting bus bar with a distributing bus bar.

The distributing bus bar design repeats that of the conducting bus bar threads (FIG. 3). The distributing bus bar, as well as the conducting bus bar, contains at least one low resistance thread 14 (FIG. 4).

Zone 6 shown in FIG. 1 consists of non-conducting threads 3 made from cotton, caprone, Kevlar, etc. that are located alongside distributing bus bars 5 and heating field 7. This zone 6 separates heating field 7 from distributing bus bar 5. Circuit breakers 13 are located in zone 6. The invention provides for use of other dielectric materials in the zone provided they can maintain the required characteristics. In this invention alternative, the resistance of conducting threads 10 and 14 may vary from 0.02 to 0.08 Ohm/cm. However, the invention provides for use of low resistance threads with other resistance parameters. This resistance and the quantity of low resistance threads 10 and 14 may vary in each alternative depending on the resistance and density of conducting resistive threads 2, as long as the heating level along threads 2 and conducting bus bars is more or less the same. Higher density and lower resistance of conducting resistive threads 2 results in larger amounts of heat being generated in the vicinity of these threads, along with a commensurable increase in the strength of current flowing through bus bars 4 and 5.

Figure 7:
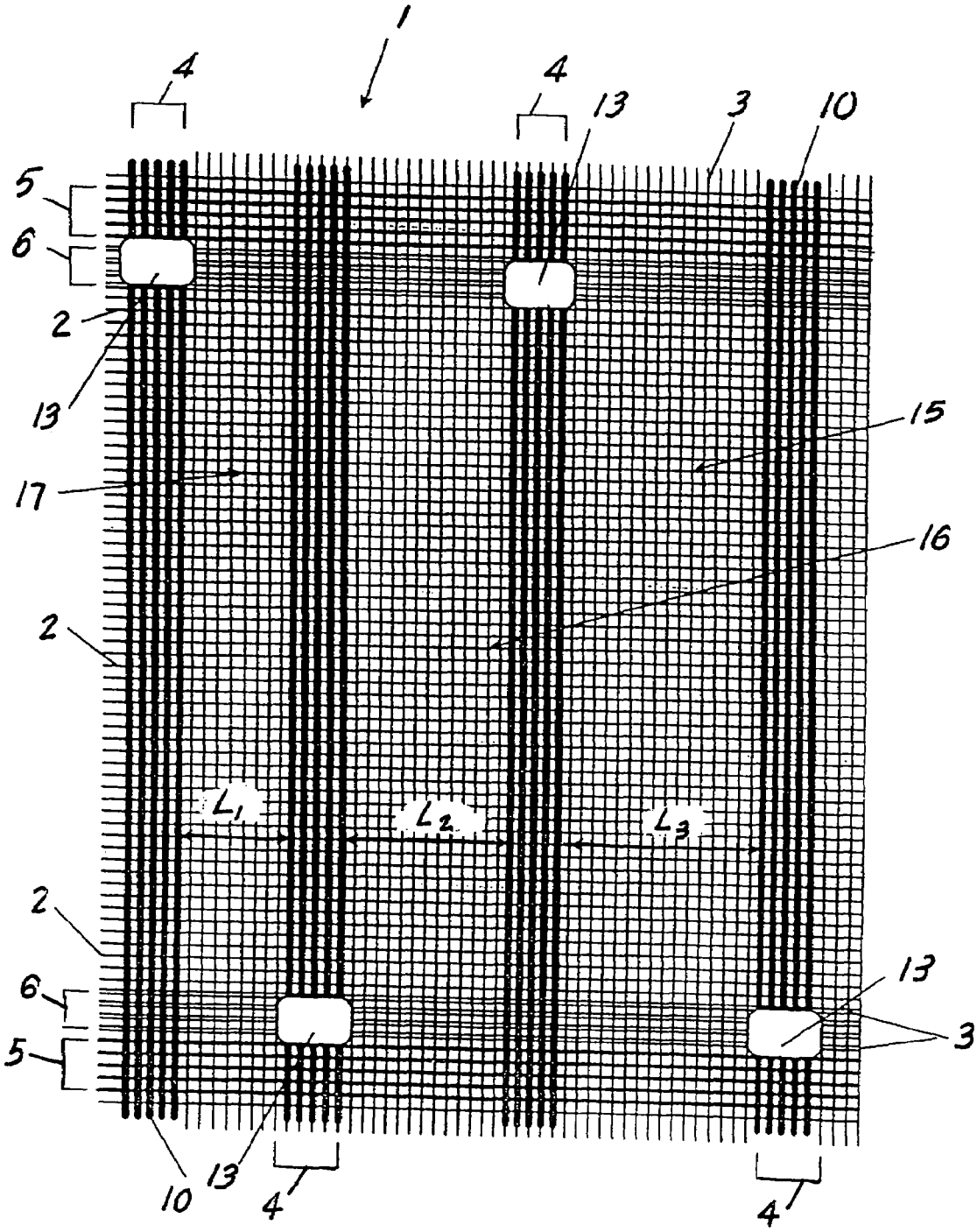
FIG. 7 is an alternate embodiment of the electric heating cloth featuring multiple heating zones of different capacity.

FIG. 7 represents another flexible electric heating thread 1 alternative. It consists of a pair of distributing bus bars 5, four conducting bus bars 4, two dielectric zones 6, a large number of electric heating conductive resistive threads 2 and cotton non-conducting threads 3. Under this alternative, three separate heating fields 15, 16 and 17 are created that have different resistances R ($R_1<R_2<R_3$) that are intended for formation of separate heating zones or sections with different power ratings P ($P_1>P_2>P_3$). The electric resistance of each section depends on the distance L ($L_1<L_2<L_3$) between two adjacent conducting bus bars. This invention provides for fabrication of a cloth with many heating fields. Distributing bus bars 5 are located in the cloth weft in order to distribute the electric energy between conducting bus bars 4. Each distributing bus bar 5 is used to connect the power source to two or more conducting bus bars 4. The electric energy flows from the power source through distributing bus bar 5 along one conducting bus bar 4 through threads 2 to another conducting bus bar, and to the opposite distributing bus bar of the heater, where the electric circuit ends. In order to prevent conducting bus bar 4 from contacting distributing bus bar 5 (as they have different voltage potentials) a stopper or circuit breaker 13 is built into zone 6. The stopper or circuit breaker 13 establishes an electrical connection between zones 15, 17 and 16.

As shown in FIG. 3, each distributing bus bar 5 consists of one or more low resistance threads 14, which is mechanically connected to low resistance threads 10 of the conducting bus bar, by interweaving. In this alternative, the type of low resistance threads of the distributing bus bar was selected the same way as low resistance threads 10 of the conducting bus bar. However, the invention provides for use of various types of threads, for example, threads that have different resistances, and also for a different number of threads in distributing bus bar 5 compared to the number of threads in conducting bus bars 4.

Nylon or Kevlar, or nomex have been used as the synthetic material for non-conducting threads, and glass fiber, or Kevlar, or nomex, or nylon have been used as the synthetic material for conducting resistive threads.

Low resistance threads consist of the primary material coated with low electric resistance material, i.e. lead or aluminum, or copper.

Nonconducting threads made from cotton or synthetic material are located in the dielectric zone and have a density of 8–18 threads per centimeter of cloth. Non-conducting primary threads are arranged at a density of 8–18 threads per centimeter of cloth, and conducting resistive threads have a density of 8–18 threads per centimeter of cloth. Conducting bus bars are 1–20 mm wide and contain from 4 to 80 separate low electric resistance threads, and distributing bus bars are 10–50 mm wide and contain from 8 to 90 separate low electric resistance threads.

Figure 8:
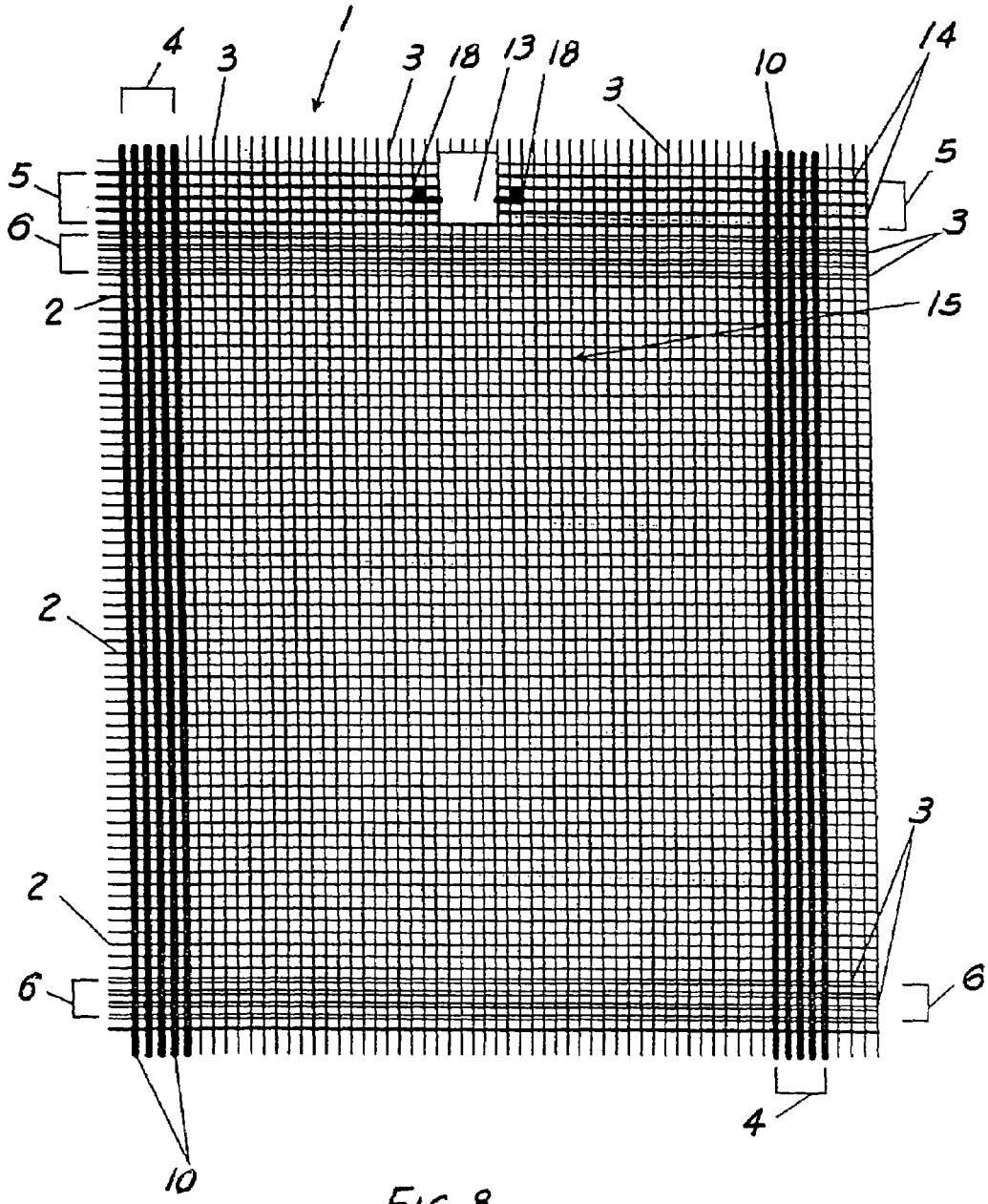
FIG. 8 is a second alternate embodiment of the electric heating cloth featuring one heating zone.

FIG. 8 shows another electric heating fabric 1 alternative. It consists of one distributing bus bar 5, two conducting bus bars 4, two zones 6 that serve as dielectric barriers, a large number of electric heating conductive resistive threads 2 and cotton or synthetic non-conducting threads 3. This alternative forms one heating field. The upper dielectric barrier separates distributing bus bar 5 from the heating field 15, and the lower dielectric barrier forms the heating field border along the cloth length. In this electric heating thread alternative, circuit breaker 13 is located in distributing bus bar 5 between conducting bus bars 4 and, for the sake of convenience of connection, may be placed either at the center between conducting bus bars 4 or closer to one of them.

With respect to the electric heating cloth shown in FIG. 1, let us review the work done by the heating material.

According to this invention, it is planned to use at least two different heating modes: i.e. the maximum heating mode and the normal heating mode. In case of the maximum heating mode, a 60–100 V voltage at 17–25A is applied to the heating element for 17–25 seconds in order to build up the temperature above 150° C. The structure of this electric heating cloth provides for uniform distribution of the heat throughout its entire surface. Both alternating and direct current may be used and the power source capacity may vary from 9 to 380 V. This invention provides for use of the electric heating cloth that may operate over various periods of time and at various temperatures in order to ensure the required heating characteristics.

At normal operating conditions, a lower voltage (13–14 V at 4–5 A current) is supplied to the heating element in order to ensure the normal operating conditions. This mode is used, for example, when it is necessary to warm up a car seat on a cold winter day. At this mode, the material is heated to 10–55° C. The operator may adjust the voltage in order to set the desired heating temperature. Besides, a material may be produced that would maintain a constant temperature over an indefinite period of time. Hereinafter, this invention is reviewed for electric heating cloth per FIG. 7 that provides for creation of multiple heating zones 15, 16 and 17 in this cloth, that are separated by conducting bus bars located at different distances from each other ($L_1<L_2<L_3$). For example, it is necessary to warrant temperature A in the first heating zone, temperature B in the second heating zone B and so on. This invention may be used in the automotive and construction industries and other sectors where creation of multiple temperature zones is desired. By creating multiple zones or fields on the same heating cloth, a particular zone may be heated to various pre-set temperatures. This may be achieved by using stoppers or circuit breakers 13 in different segments of zone 6, thus making it possible for each electric field to be connected in parallel with the adjacent field. Circuit breakers have contacts 18 in order to connect the power source wires. This invention also allows to minimize the number of electric outlets.

Figure 9:
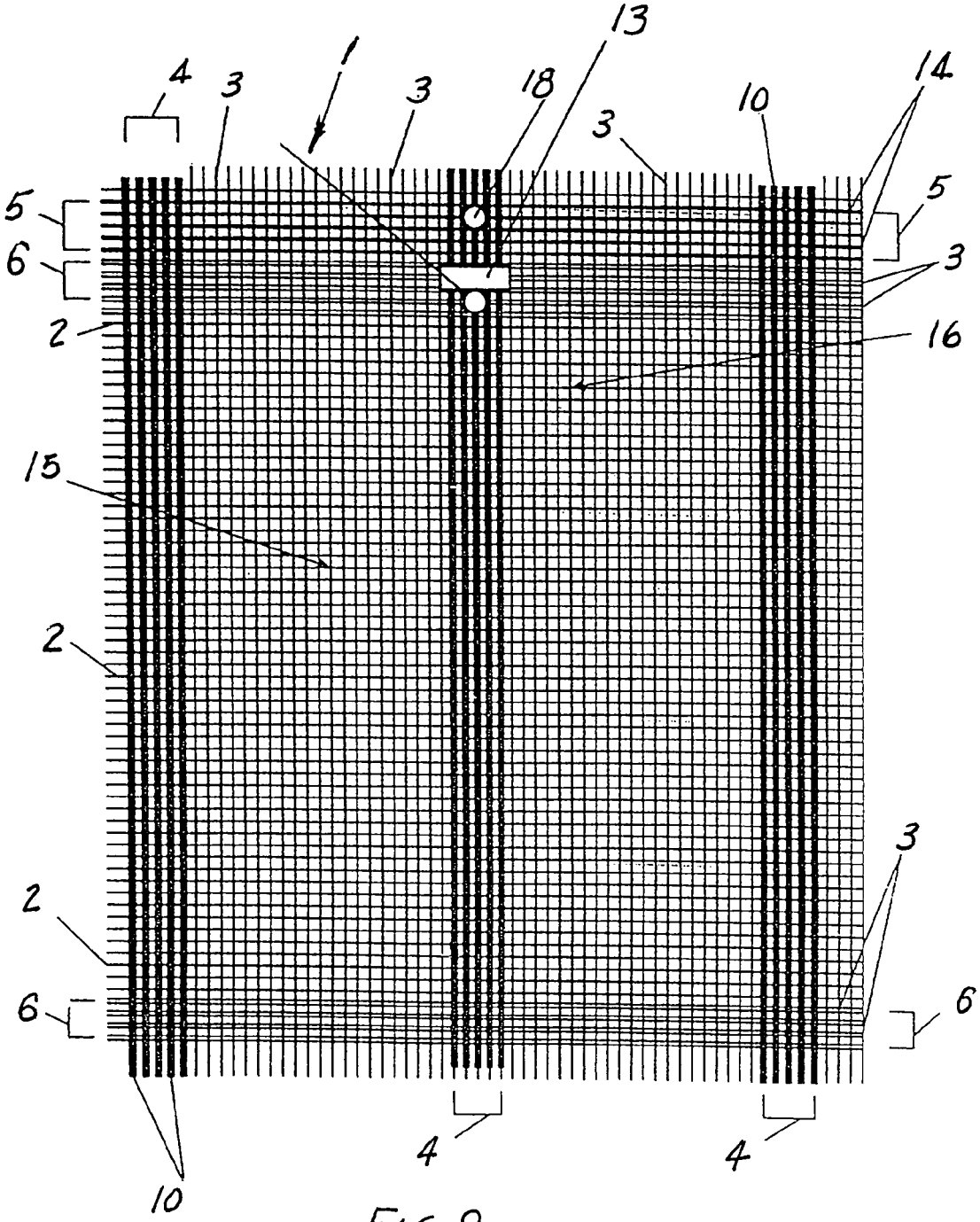
FIG. 9 is a third alternate embodiment of the electric heating cloth featuring two heating zones and two dielectric barriers.

FIG. 9 shows electric heating cloth made in the form of interweaved threads that consist of primary non-conducting cotton or synthetic threads, arranged in the first direction, and 2.7–1800 Ohm/cm linear electric resistance conducting resistive filaments arranged in the second direction, perpendicular to the first one, each of them consisting of synthetic or glass fiber with a shell from polymer resistive material that contains a carbon filler consisting of industrial carbon and graphite. The cloth also has at least three conducting bus bars arranged in the first direction which coincides with the direction of the primary non-conducting threads for distribution of electric energy between conducting resistive threads, and at least one distributing bus bar arranged in the second direction which coincides with the direction of conducting resistive threads and separated from the latter by non-conducting cotton or synthetic threads that are arranged in the second direction as well and create a dielectric barrier between the distributing bus bar and conducting resistive threads, in which there is a circuit breaker for distribution of the electric energy between the conducting bus bars. The said conducting bus bars ar located in the cloth at pre-set distances between each other in order to create two heating sections. Each said distributing bus bar and the distributing bus bar contains at least one low electric resistance thread. In the cloth there is an additional dielectric barrier located at the border of the cloth opposite to the location of the dielectric barrier in which the circuit breaker is positioned. The lower dielectric barrier forms the heating field border along the cloth length.

From the afore-mentioned, it becomes clear that the invention is a device to supply homogeneous heat in controlled quantities. Also, the device may operate during a certain period of time at elevated temperatures in order to increase the production volumes of heated car seats. Other alternatives besides those reviewed above are also possible.

In order to produce cloth with the operating properties according to the invention, a resistive conducting thread of a "shell-nucleus" structure is used, in which the "nucleus" is made from synthetic of glass fiber or fibers and the resistive "shell" is a polymer carbon-containing composite. The fiber itself may be monolithic or present a combination of separate threads.

For fabrication of the conducting resistive thread the "nucleus" is made up of twisted synthetic or glass threads (two or three threads with 40–50 twists per meter at the linear density of 28–50 tex). Threads of various cross section shapes are used as synthetic threads.

The polymer carbon-containing composite serving as resistive "shell" consists of polyvinylidene fluoride thermosoftening plastic, industrial carbon produced from acetylene and colloid graphite.

Polyvinylidene fluoride is a thermoplastic polymer whose molecular mass is 80 000–200 000, density is 1.77 g/cm$^3$, melting point is 160–170° C., decompostion temperature is >300‖C., operating temperature range is from −40 to +150° C. It dissolves in acetone, dimethyl formamide, dimethyl sulfoxide and does not dissolve in water. Polyvinylidene fluoride is produced by radical polymerization of vinylidene fluoride. Polyvinylidene fluoride is used in production of electric insulation, elected films, thermosetting tubes, fibers, etc.

Research shows that, from a wide range of industrial carbon grades, industrial carbon A144-Э (14-106-357-90. Elemental industrial carbon A144-Э) has the biggest effect on the electric properties of the resistive material of the "shell". This material is produced in the course of thermal decomposition of acetylene at high pressure (explosion process) and is used during production of chemical current sources, magnetic information carriers, polymer and rubber composites. Industrial carbon produced from acetylene has low ash content (not more than 0.07%), high fraction of total pure carbon mass (not less than 99.75%) and high specific surface (140–160 m$^2$/g).

Use of finely pulverized (0.5–100 micron) particles of natural graphite with dense crystalline, flaky or amorphous structure, or artificial graphite, in the polymer resistive material hinders solution of the problem which is, most probably, caused by the structure of their crystalline lattice. If the graphites mentioned above are present in the polymer resistive material composition, the cross section of the "shell" has to be increased in order to reduce the linear electric resistance of the thread, which causes the consumption of the polymer resistive material to increase.

According to the invention, the said shortcoming of the resistive material composition may be eliminated by adding industrial carbon produced from acetylene and colloid graphite with particle size less than 5 micron to it.

One of the ways to produce colloid graphite is to transform the surface of finely dispersed graphite particles from hydrophobic type into hydrophilic. This is possible when oxygen-bearing functional groups are formed on it that promote its wetting. For this purpose, the thermally decalcified natural graphite of a flaky structure is subjected to vibration grinding followed by treatment with a mixture of anhydrous nitric and sulfuric acids and water at 900° C. The last stage of treatment of graphite particles in acids is formation of graphite oxide. Limitations on the time and temperature of treatment, as well as the dimensions of particles being dispersed make it possible to suspend this process at the colloid graphite formation stage. After this treatment, graphite particles are thoroughly rinsed to remove the oxidizing mixture and filtered, and thus become capable of forming colloid solutions with water, methyl and ethyl alcohols and acetone. Special advantages of colloid graphite lie in its ability, to form, upon drying, films with good adhesion to the substrate, with stable electric conductivity and no gas evolution. Depending on the preparation conditions, the specific surface of colloid graphite particles is within 1000–1500 m$^2$/g.

Colloid graphite is mainly used to produce colloid-graphite substances for lubrication of hot stamping dies, lubrication of heavy-duty plain bearings. They are also used as conducting coating of glass CRTs and magnetic tapes.

Linear electric resistance of the conducting thread depends on the properties of the polymer resistive material, and the mass ratio of the resistive material and the primary thread. In its turn, properties of polymer resistive material depend on its components and their ratio.

Experiments aimed at optimization of the polymer resistive material composition showed that conductive threads with 0.2–180 kOhm/m linear electric resistance can be produced under the following conditions:

- the mass ratio of industrial carbon produced from acetylene and colloid graphite should be maintained within the 1:0.1–1:1.4, respectively;
- the mass ratio of polyvinylidene fluoride thermosoftening plastic and carbon filler should be maintained within the 1:0.3–1:0.6, respectively;
- the mass ratio of polymer resistive material and primary thread should be maintained within the 0.2:1–0.65:1, respectively;

If the colloid graphite concentration level becomes less than the specified value, the conducting thread resistance exceeds the maximum allowed limit and becomes unstable over the thread length. With the colloid graphite concentration growing beyond the indicated value, the physical and mechanical properties of the resistive shell deteriorate and it is destroyed in the cloth fabrication process.

If the concentration of carbon filler in the resistive material drops lower than the indicated value, the conducting thread linear electric resistance grows beyond the maximum allowed limit, which makes it unsuitable for fabrication of woven heating elements. With the carbon filler concentration growing beyond the indicated value, the physical and mechanical properties of the resistive shell and its adhesion to the thread deteriorate, which makes the conducting thread unsuitable for fabrication of the cloth.

If the amount of the resistive material applied on the primary thread is less than specified, the coating continuity is jeopardized, making the thread non-conducting. Application of too much of the resistive material on the thread does not make it cost-efficient.

According to the invention, the conducting resistive thread fabrication method lies in preparation of the resistive material, which contains carbon filler consisting of industrial carbon and graphite, and its application on the synthetic or glass fiber in the shape of a shell. In order to prepare the said polymer resistive material a 12–15% solution of polyvinylidene fluoride in acetone is produced by mixing components in an air-tight mixer at room temperature until the thermosoftening plastic is completely dissolved. The industrial carbon is mixed with the polymer solution produced, the resulting suspension is made to circulate in a closed "mixer-grinder-mixer" loop to ensure dispersion of the industrial carbon particles and production of a homogeneous solution, which is then mixed with colloid graphite, and the entire mixture is ground and then applied in the form of a shell on the source fiber by passing it through the solution and a spinneret whose orifice diameter controls the amount of the resistive material to be applied on the fiber. After that, the solvent is removed from the resistive shell by drying the thread in a hot air stream at 105–110° C.

The production technology of the conducting resistive thread according to the invention includes the following stages:

- preparation of a 12–15% solution of polyvinylidene fluoride in acetone by mixing components in an air-tight mixer at room temperature until the thermosoftening plastic is completely dissolved;
- mixing of industrial carbon with the polymer solution produced;
- circulation of the suspension produced in a closed "mixer-grinder-mixer" loop to ensure dispersion of the industrial carbon particles and production of a homogeneous solution;
- mixing of the homogenous solution produced with colloid graphite and grinding of the mixture;
- application of a polymer resistive material shell on the primary thread by passing it through the solution and a spinneret whose orifice diameter controls the amount of the resistive material to be applied on the thread;
- removal of the solvent from the resistive shell by drying the filament in a hot air stream at 105–110° C.

Use of polyvinylidene fluoride thermosoftening plastic, industrial carbon produced from acetylene and colloid graphite in order to produce a conducting resistive thread made it possible to reduce the consumption of the polymer resistive material to be applied to the primary thread and expand the conducting thread linear electric resistance range.

The essence of the invention is explained by the following examples.

EXAMPLE 1

100 mass parts of polyvinylidene fluoride thermosoftening plastic are dissolved by mixing in 600 mass parts of acetone. After that, 50 mass parts of industrial carbon produced from acetylene are added to the solution, the mixture is mixed and ground and 7 mass parts of colloid graphite are added during mixing. The resultant mixture is ground again.

The polymer resistive material is applied on 35-gauge twisted polyester thread that has 40 twists per meter (linear density —28.6 tex (0.0286 g/m). The polymer resistive material is applied on the fiber at 20° C., at the fiber pulling speed of 25 m/min. The thread goes through a resistive material solution and then through a spinneret whose orifice diameter controls the amount of the resistive material to be applied on the fiber. When the fiber comes out of the spinneret, it is dried in the hot air stream at 105–110° C. in order to remove the solvent and then wound on a spool. This results in production of conducting resistive thread whose characteristics are shown in the Table, examples 1/1 and 1/2.

EXAMPLE 2

100 mass parts of polyvinylidene fluoride thermosoftening plastic are dissolved by mixing in 700 mass parts of acetone. After that, 15 mass parts of industrial carbon produced from acetylene are added to the solution, the mixture is mixed and ground and 20 mass parts of colloid graphite are added during mixing. The resultant mixture is ground again.

The polymer resistive material is applied on the thread, as described in Example 1.

This results in production of conducting resistive thread whose characteristics are shown in the Table, examples 2/1 and 2/2.

EXAMPLE 3

100 mass parts of polyvinylidene fluoride thermosoftening plastic are dissolved by mixing in 650 mass parts of acetone. After that, 27 mass parts of industrial carbon produced from acetylene are added to the solution, the mixture is mixed and ground and 23 mass parts of colloid graphite are added during mixing. The resultant mixture is ground again.

The polymer resistive material is applied on 20-gauge twisted polyester thread that has 50 twists per meter (linear density —50 tex (0.050 g/m) at the fiber pulling speed of 20 m/min. This results in production of conducting resistive thread whose characteristics are shown in the Table, examples 3/1 and 3/2.

EXAMPLE 4

Polymer resistive material solution similar to example 3 is prepared.

The polymer resistive material is applied on 20-gauge twisted glass thread that has 45 twists per meter (linear density —50 tex (0.050 g/m) at the thread pulling speed of 20 m/min. Polymer resistive material is applied on the thread similarly to example 3, but at the thread pulling speed of 15 m/min. This results in production of conducting resistive thread whose characteristics are shown in the Table, examples 4/1 and 4/2.

The Table also shows characteristics of the conducting resistive thread produced according to prototype (U.S. Pat. No. 4,783,814, example 1, sample 4). From the data provided it transpires that the conducting resistive thread produced according to the invention (example 3/1 and 3/2) requires 4–5 times less resistive material, with linear electric resistance being comparable with that of the prototype conductive thread.

This result was achieved due to: a) use of polymer resistive polyvinylidene fluoride composite, that dissolves well in acetone, colloid graphite capable of forming a colloid solution in the presence of acetone and reacting with particles of industrial carbon produced from acetylene on the level of functional groups located on their developed surfaces, thus making it possible to increase the conductivity of the polymer resistive material, and this, in its turn, provides for lowering in consumption during fabrication of conducting resistive thread with the desired linear electric resistance; b) a certain ratio between the carbon filler and polymer material, as well as polymer resistive material and the primary thread.

Although only several embodiments have been described it is not my intention to these embodiments since such changes as: substitution of elements; changes in proportions of elements, and changes in the sequence of steps can be made which are obvious to persons skilled in the art without departing from the spirit thereof.

TABLE

| Example/ Sample # | Industrial carbon/ colloidal graphite mass ratio | Polymer/ carbon filter mass ratio | Spinneret orifice diameter mm | Mass of 1 m of thread with coating gm | Mass of 1 m of primary thread gm | Mass of resistive heating coating gm | Resitive material/thread mass ratio | Thread linear electric resistance, KOhm/m |
|---|---|---|---|---|---|---|---|---|
| 1/1 | 1:0.14 | 1:0.57 | 0.30 | 0.0472 | 0.0286 | 0.0186 | 0.65:1 | 78.2 |
| 1/2 | 1:0.14 | 1:0.57 | 0.25 | 0.0356 | 0.0286 | 0.0070 | 0.24:1 | 170.5 |
| 2/1 | 1:1.33 | 1:0.35 | 0.30 | 0.0402 | 0.0286 | 0.0116 | 0.40:1 | 99.7 |
| 2/2 | 1:1.33 | 1:0.35 | 0.25 | 0.0346 | 0.0286 | 0.0060 | 0.21:1 | 178.8 |
| 3/1 | 1:0.85 | 1:0.50 | 0.40 | 0.0770 | 0.0500 | 0.0270 | 0.54:1 | 16.3 |
| 3/2 | 1:0.85 | 1:0.50 | 0.35 | 0.0720 | 0.0500 | 0.0220 | 0.44:1 | 28.7 |
| 4/1 | 1:0.85 | 1:0.50 | 0.40 | 0.0825 | 0.0500 | 0.0325 | 0.65:1 | 0.28 |
| 4/2 | 1:0.85 | 1:0.50 | 0.35 | 0.0750 | 0.0500 | 0.0250 | 0.50:1 | 10.5 |
| U.S. Pat. No. 4,983,814 | Industrial carbon/ graphite mass ratio | Polyurethane resin/carbon mass ratio | | | | | | |
| 1/4 | 1:0.6 | 1:0.8 | 0.50 | 0.1350 | 0.0500 | 0.085 | 1.7:1 | 31.1 |
| | 1:0.6 | 1:0.8 | 0.70/1.0 | 0.180 | 0.0500 | 0.13 | 2.6:1 | 13.8 |

What I claim is new is:

1. A method for producing an electric heating cloth which is heated uniformly and is characterized by high reliability and high flexibility comprising the steps of: interweaving a first group of flexible non-conducting threads arranged in a first direction with a single second group of flexible heating resistive threads arranged in a second direction which is perpendiculay to said first direction, each of said single second group of heating resistive threads characterized by a shell-nucleus structure wherein said nucleus is made of twisted flexible synthetic or glass fiber or fibers, said shell formed by dissolving a thermoplastic polymer in an organic solvent; adding an industrial carbon which is produced from acetylene to form a first mixture; grinding said first mixture; adding a colloidal graphite to said first mixture of thermoplastic polymer and organic solvent to form a second mixture; grinding said second mixture; coating a thread with said second mixture in a spinneret; and heating said coated heating resistive thread to remove said organic solvent.

2. The method according to claim 1 wherein said thermoplastic polymer is polyvinylidene.

3. The method according to claim 1 wherein said organic solvent is acetone.

4. The method according to claim 1 wherein said thermoplastic polymer is dissolved in said organic solvent in a ratio of one mass part of said polymer to six mass parts of solvent.

5. The method according to claim 1 wherein said industrial carbon is added to said thermoplastic polymer and said organic solvent in a ratio of one mass part of said industrial carbon to two mass parts of said thermoplastic polymer.

6. The method according to claim 1 wherein said thread is a polyester thread of 35 AWG.

7. The method according to claim 1 wherein said thread is coated with said second mixture at 20 ° C. and said thread is coated in said spinneret at a pulling speed of about 25 m/min.

8. The method according to claim 6 wherein said thread has 40 twists per meter and a linear density of 0.0286 g/m.

9. The method according to claim 1 wherein said coated thread is dried in a hot air stream at 105–110 ° C.

10. The method according to claim 1 wherein said thermoplastic polymer is dissolved in said organic solvent in a ratio of one mass part of polymer to seven mass parts of solvent.

11. The method according to claim 1 wherein said industrial carbon is added to said thermoplastic polymer and said organic solvent in a ratio of five mass parts of said industrial carbon to twenty mass parts of said thermoplastic polymer.

12. The method according to claim 1 wherein said thermoplastic polymer is dissolved in said organic solvent in a ratio of one mass part of polymer to six and a half mass parts of solvent.

13. The method according to claim 1 wherein said thread is a twisted glass thread of 20 gauge, 45 twists per meter and a linear density of 0.050g/m and is pulled in said spinneret at a speed of 15 m/min.

14. The method according to claim 1 wherein each of said second group of heating conductive resistive threads has an outer diameter of less than 0.7 mm.

15. The method according to claim 1 wherein said interwoven threads are arranged in multiple heating zones.

16. The method according to claim 1 wherein each of said heating resistive threads has a linear resistance in the range of 2.7–1800 Ohm/cm.

17. The method according to claim 1 wherein said interwoven non-conducting threads and said heating conducting resistive threads have linear densities of about 8–18 threads per centimeter of said cloth.

18. A method for producing an electric heating cloth which is heated uniformly and is characterized by high reliability and high flexibility comprising the steps of: interweaving a first group of non-conducting threads arranged in a first direction with a single second group of heating resistive threads, each of said single second group of heating resistive threads formed by dissolving a thermoplastic polymer in an organic solvent; adding an industrial carbon to said solution of thermoplastic polymer and organic solvent to form a first mixture; grinding said first mixture; adding a colloidal graphite to said first mixture to form a second mixture; grinding said second mixture; coating a nucleus made of twisted flexible synthetic or glass fiber or fibers with said second mixture in a spinneret; and drying said coated thread to remove said organic solvent.

19. The method according to claim 18 wherein said industrial carbon is produced from acetylene.

* * * * *